US012031290B2

(12) United States Patent
Oasa

(10) Patent No.: US 12,031,290 B2
(45) Date of Patent: Jul. 9, 2024

(54) WORK MACHINE CONTROL DEVICE, WORK VEHICLE, AND METHOD OF CONTROLLING WORK MACHINE

(71) Applicant: KOMATSU LTD., Tokyo (JP)

(72) Inventor: Takahisa Oasa, Tokyo (JP)

(73) Assignee: KOMATSU LTD., Tokyo (JP)

( * ) Notice: Subject to any disclaimer, the term of this patent is extended or adjusted under 35 U.S.C. 154(b) by 399 days.

(21) Appl. No.: 17/420,605

(22) PCT Filed: Apr. 2, 2020

(86) PCT No.: PCT/JP2020/015146
§ 371 (c)(1),
(2) Date: Jul. 2, 2021

(87) PCT Pub. No.: WO2020/204123
PCT Pub. Date: Oct. 8, 2020

(65) Prior Publication Data

US 2022/0090348 A1 Mar. 24, 2022

(30) Foreign Application Priority Data

Apr. 4, 2019 (JP) ..... 2019-072103

(51) Int. Cl.
*E02F 3/43* (2006.01)
*E02F 9/26* (2006.01)

(52) U.S. Cl.
CPC ..... *E02F 3/431* (2013.01); *E02F 9/265* (2013.01)

(58) Field of Classification Search
CPC ..... E02F 3/431; E02F 9/265; E02F 9/2029; E02F 9/2203; E02F 9/2296
See application file for complete search history.

(56) References Cited

U.S. PATENT DOCUMENTS 5,528,843 A 6/1996 Rocke
2001/0056319 A1 12/2001 Rocke
(Continued)

FOREIGN PATENT DOCUMENTS

CN 103748291 A 4/2014
CN 106574455 A 4/2017
(Continued)

OTHER PUBLICATIONS

The International Search Report for the corresponding international application No. PCT/JP2020/015146, issued on Jun. 23, 2020.

*Primary Examiner* — Peter D Nolan
*Assistant Examiner* — Demetra R Smith-Stewart
(74) *Attorney, Agent, or Firm* — Global IP Counselors, LLP

(57) ABSTRACT

A work machine control device includes a lift force detection unit, a control amount determination unit, and a command output unit. The lift force detection unit detects a lift force of the work machine. The control amount determination unit determines a control amount for the work machine based on a change amount of the detected lift force. The command output unit outputs, to an actuator driving the work machine, a control command according to the determined control amount. The control amount determination unit determines the control amount such that the control amount monotonically increases with respect to the lift force until a lift amount of the work machine reaches a predetermined threshold. A work vehicle includes the work machine control device, a vehicle body, a work machine supported by the vehicle body, and an actuator that drives the work machine.

7 Claims, 8 Drawing Sheets

(56) References Cited

U.S. PATENT DOCUMENTS

| | | | | |
|---|---|---|---|---|
| 2004/0117092 | A1 | 6/2004 | Budde | |
| 2006/0245896 | A1 | 11/2006 | Alshaer et al. | |
| 2008/0295679 | A1 | 12/2008 | Callaghan et al. | |
| 2009/0228394 | A1* | 9/2009 | Mintah | E02F 9/264 705/50 |
| 2009/0240404 | A1* | 9/2009 | Matsuyawa | F02D 29/02 701/50 |
| 2012/0310484 | A1* | 12/2012 | Higuchi | B60R 21/0132 701/1 |
| 2013/0045072 | A1 | 2/2013 | Jensen | |
| 2014/0207346 | A1 | 7/2014 | Filla et al. | |
| 2016/0040391 | A1 | 2/2016 | Imaizumi et al. | |
| 2017/0037594 | A1 | 2/2017 | Wada et al. | |

FOREIGN PATENT DOCUMENTS

| | | | |
|---|---|---|---|
| EP | 2 853 641 | A1 | 4/2015 |
| JP | 61-209504 | A | 9/1986 |
| JP | 2001-164596 | A | 6/2001 |
| JP | 3907720 | B2 | 4/2007 |
| JP | 5700613 | B1 | 4/2015 |
| JP | 2016-44752 | A | 4/2016 |

* cited by examiner

WORK MACHINE CONTROL DEVICE, WORK VEHICLE, AND METHOD OF CONTROLLING WORK MACHINE

CROSS REFERENCE TO RELATED APPLICATION(S)

This application is a U.S. National stage application of International Application No. PCT/JP2020/015146, filed on Apr. 2, 2020. This U.S. National stage application claims priority under 35 U.S.C. § 119(a) to Japanese Patent Application No. 2019-072103, filed in Japan on Apr. 4, 2019, the entire contents of which are hereby incorporated herein by reference.

BACKGROUND

Field of the Invention

The present invention relates to a work machine control device, a work vehicle, and a method of controlling a work machine.

Background Information

Japanese Patent No. 5700613 discloses a technology relating to a wheel loader having a function of automatically performing excavation.

According to the technology disclosed in Japanese Patent No. 5700613, a control device of the wheel loader detects that a work machine is bitten into a load, by using a bottom pressure of a boom, and while the boom is lifted, a bucket is intermittently tilted. In this manner, it is possible to realize automatic excavation that simulates excavation work of the wheel loader which is carried out by an operator.

SUMMARY

According to the technology disclosed in Japanese Patent No. 5700613, the control device of the wheel loader performs lift control with a constant lift control amount, and performs tilt control with a constant tilt control amount. However, when the work machine is controlled with a constant control amount, there is a possibility that proper excavation control may not be possible depending on a state of an excavation object.

An object of the present invention is to provide a work machine control device, a work vehicle, and a method of controlling a work machine, which are capable of performing excavation control in accordance with a state of an excavation object.

According to one aspect of the present invention, there is provided a work machine control device that controls a work machine. The work machine control device includes a lift force detection unit that detects a lift force of the work machine, a control amount determination unit that determines a control amount for the work machine based on a change amount of the detected lift force, and a command output unit that outputs, to an actuator driving the work machine, a control command according to the determined control amount.

According to the above-described aspect, the work machine control device can perform excavation control in accordance with a state of an excavation object.

DETAILED DESCRIPTION OF EMBODIMENT(S)

First Embodiment

Hereinafter, an embodiment will be described in detail with reference to the drawings.

Figure 1:
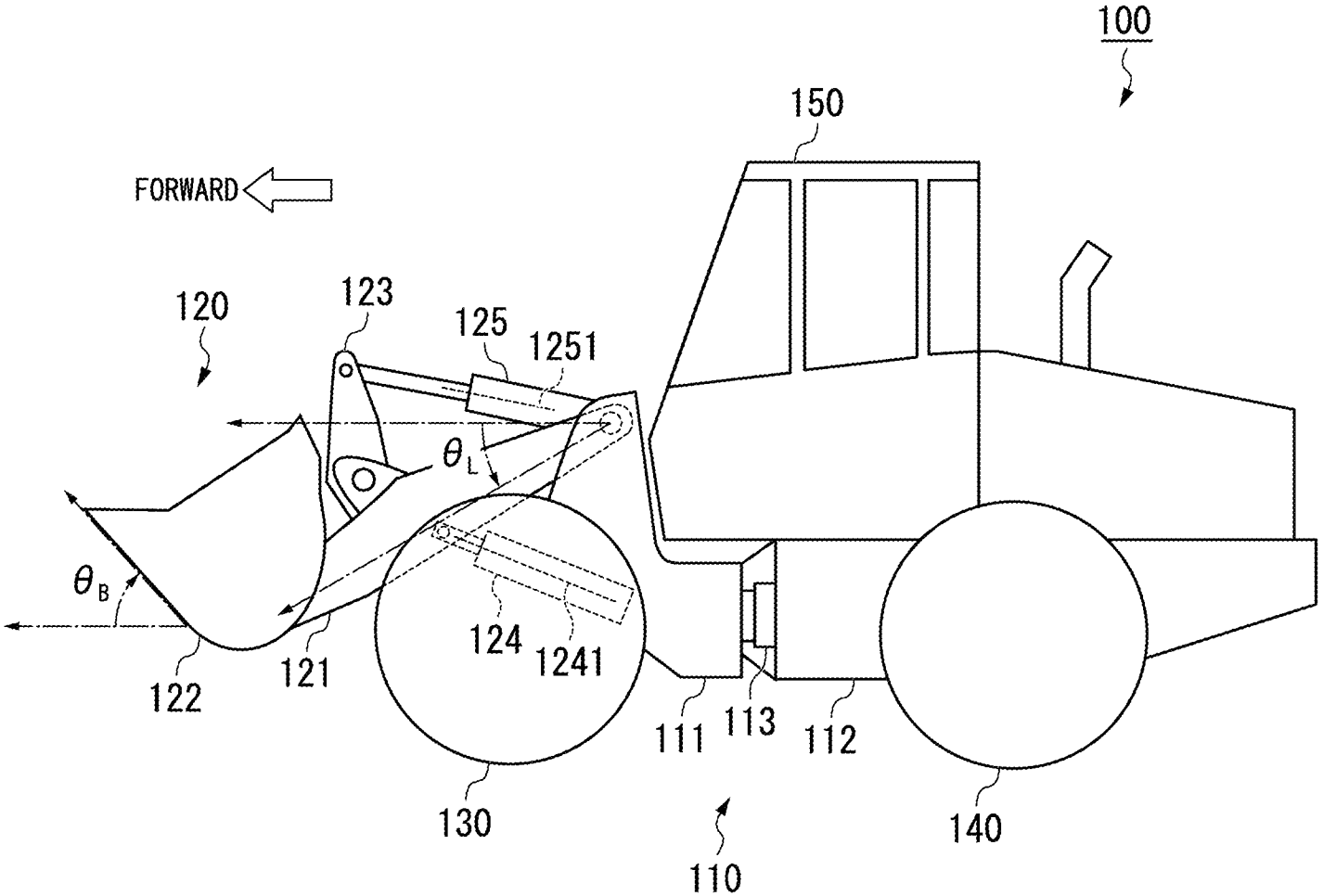
FIG. 1 is a side view of a work vehicle according to a first embodiment.

FIG. 1 is a side view of a work vehicle according to a first embodiment.

A work vehicle 100 according to the first embodiment is a wheel loader. The work vehicle 100 includes a vehicle body 110, a work machine 120, a front wheel part 130, a rear wheel part 140, and a cab 150.

The vehicle body 110 includes a front vehicle body 111, a rear vehicle body 112, and a steering cylinder 113. The front vehicle body 111 and the rear vehicle body 112 are attached to be pivotable around a steering shaft extending in an upward-downward direction of the vehicle body 110. The front wheel part 130 is provided at a lower part of the front vehicle body 111, and the rear wheel part 140 is provided at a lower part of the rear vehicle body 112.

The steering cylinder 113 is a hydraulic cylinder. A base end portion of the steering cylinder 113 is attached to the rear vehicle body 112, and a tip portion of the steering cylinder 113 is attached to the front vehicle body 111. The steering cylinder 113 is expanded and contracted by hydraulic oil, thereby defining an angle formed between the front vehicle body 111 and the rear vehicle body 112. That is, a steering angle of the front wheel part 130 is defined by expansion and contraction of the steering cylinder 113.

The work machine 120 is used for excavating and transporting a work object such as earth and sand. The work machine 120 is provided at a front part of the vehicle body 110. The work machine 120 includes a boom 121, a bucket 122, a bell crank 123, a lift cylinder 124, and a bucket cylinder 125.

A base end portion of the boom 121 is attached to a front part of the front vehicle body 111 via a pin.

The bucket 122 includes a blade for excavating the work object and a container for transporting the excavated work object. A base end portion of the bucket 122 is attached to a tip portion of the boom 121 via a pin.

The bell crank 123 transmits a power of the bucket cylinder 125 to the bucket 122. A first end of the bell crank 123 is attached to a bottom portion of the bucket 122 via a link mechanism. A second end of the bell crank 123 is attached to a tip portion of the bucket cylinder 125 via a pin.

The lift cylinder 124 is a hydraulic cylinder. A base end portion of the lift cylinder 124 is attached to a front part of the front vehicle body 111. A tip portion of the lift cylinder 124 is attached to the boom 121. As the lift cylinder 124 is expanded and contracted by the hydraulic oil, the boom 121 is driven in an upward direction or a downward direction. The lift cylinder 124 is provided with a lift stroke sensor 1241 for measuring a stroke amount of the lift cylinder 124. The stroke amount of the lift cylinder 124 is used to obtain a boom angle $\theta_L$. The boom angle $\theta_L$ is represented by an angle formed between a straight line extending forward from the vehicle body 110 and a straight line extending from a base end portion of the boom 121 to a tip portion of the boom 121. As the boom angle $\theta_L$ increases, a position of the tip portion of the boom 121 becomes higher. As the boom angle $\theta_L$ decreases, the position of the tip portion of the boom 121 becomes lower. In another embodiment, the boom angle $\theta_L$ may be calculated by an angle sensor provided at the base end portion of the boom 121.

The bucket cylinder 125 is a hydraulic cylinder. A base end portion of the bucket cylinder 125 is attached to a front part of the front vehicle body 111. A tip portion of the bucket cylinder 125 is attached to the bucket 122 via the bell crank 123. As the bucket cylinder 125 is expanded and contracted by the hydraulic oil, the bucket 122 is driven in a tilt direction or a dump direction. The bucket cylinder 125 is provided with a bucket stroke sensor 1251 for measuring a stroke amount of the bucket cylinder 125. The stroke amount of the bucket cylinder 125 is used to obtain a bucket angle $\theta_B$. The bucket angle $\theta_B$ is represented by an angle formed between a straight line extending forward from the vehicle body 110 and a straight line extending along a bottom surface of the bucket 122. When the bucket angle $\theta_B$ is positive, the bucket 122 is tilted to a tilt side, and when the bucket angle $\theta_B$ is negative, the bucket 122 is tilted to a dump side. The bucket angle $\theta_B$ is obtained by adding the boom angle $\theta_L$ to an angle of the bucket 122 with reference to the boom 121 which is obtained from the stroke amount of the bucket cylinder 125 and the boom angle. In another embodiment, the bucket angle $\theta_B$ may be calculated by an angle sensor provided at a central portion of the bell crank 123.

The cab 150 is a space for an operator who rides on the space to operate the work vehicle 100. The cab 150 is provided at an upper part of the rear vehicle body 112.

Figure 2:
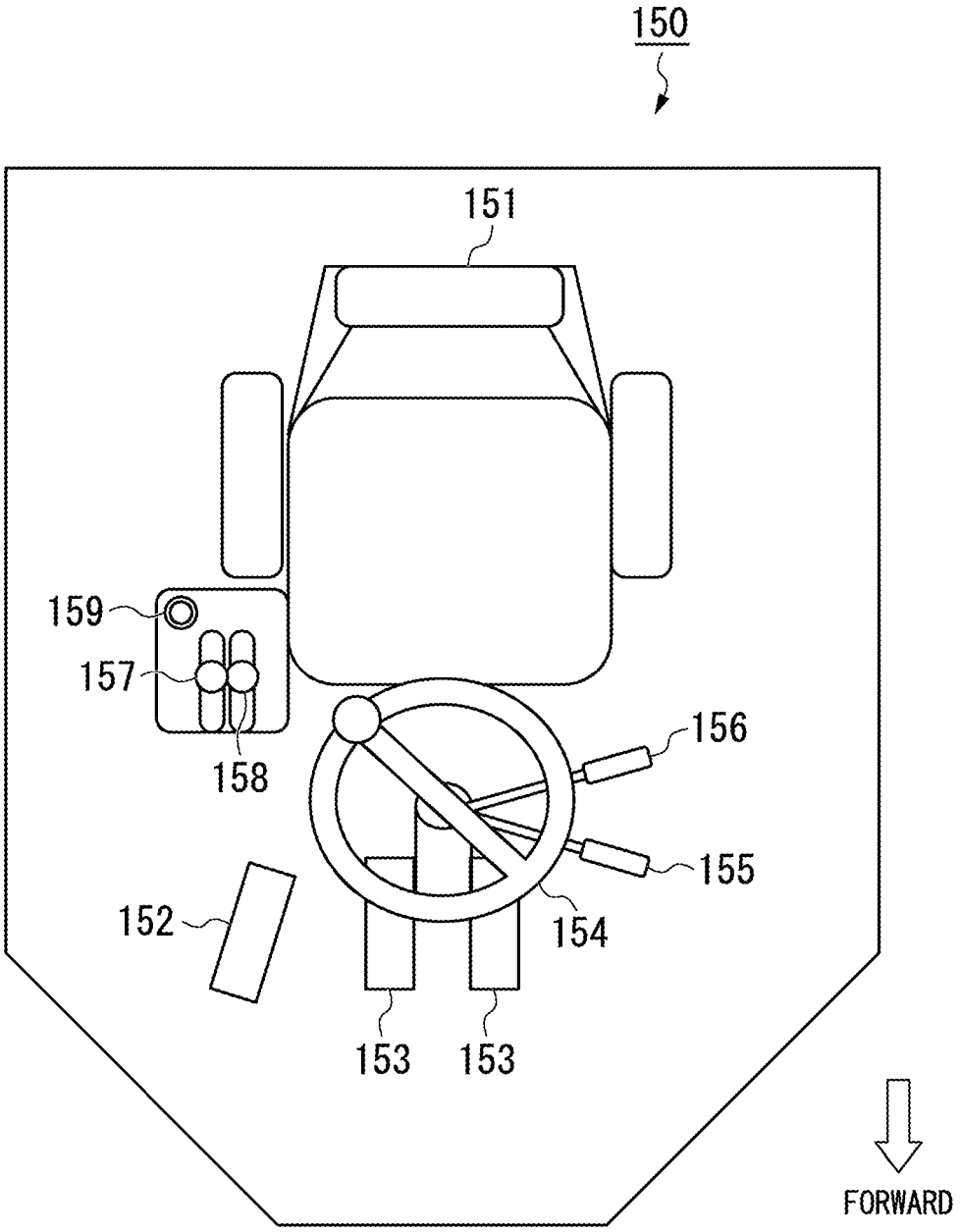
FIG. 2 is a top view showing an internal configuration of a cab according to the first embodiment.

FIG. 2 is a top view showing an internal configuration of the cab according to the first embodiment. The cab 150 is internally provided with a seat 151, an accelerator pedal 152, a brake pedal 153, a steering wheel 154, a front/rear selection switch 155, a shift switch 156, a boom lever 157, a bucket lever 158, and an automatic excavation switch 159.

The accelerator pedal 152 is operated to set a driving force (traction force) for traveling which is generated in the work vehicle 100.

The brake pedal 153 is operated to set a braking force against traveling which is generated in the work vehicle 100. As the operation amount of the brake pedal 153 increases, the braking force is set to be stronger.

The steering wheel 154 is operated to set a steering angle of the work vehicle 100.

The front/rear selection switch 155 is operated to set a traveling direction of the work vehicle 100.

The shift switch 156 is operated to set a speed range of the power transmission device. For example, the shift switch 156 is operated to select one speed range from a first speed, a second speed, a third speed, and a fourth speed.

The boom lever 157 is operated to set a speed of a raising operation or a lowering operation of the boom 121. The boom lever 157 receives the lowering operation when tilted forward, and receives the raising operation when tilted rearward. Hereinafter, the raising operation and the lowering operation of the boom 121 will be referred to as a lift operation.

The bucket lever 158 is operated to set a speed of a dump operation or a tilt operation of the bucket 122. The bucket lever 158 receives the dump operation when tilted forward, and receives the tilt operation when tilted rearward.

The automatic excavation switch 159 is operated to switch between enabling and disabling automatic excavation control. The automatic excavation switch 159 is pressed to output a signal indicating enabling or disabling automatic excavation control to the control device 300. In another embodiment, instead of the operation of the automatic excavation switch 159, enabling or disabling automatic excavation control may be set by a predetermined lever operation.

Power System

Figure 3:
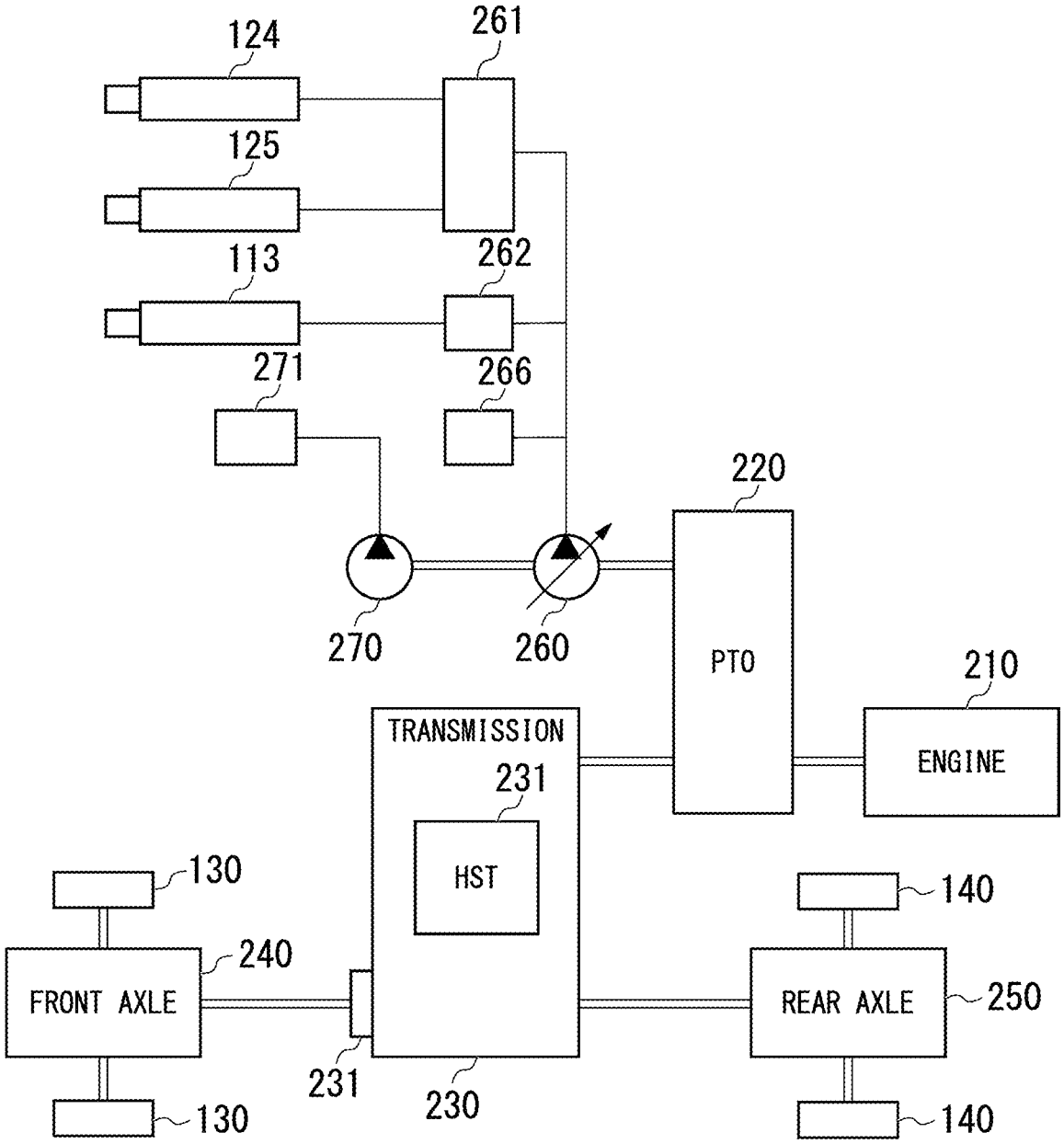
FIG. 3 is a schematic view showing a power system of the work vehicle according to the first embodiment.

FIG. 3 is a schematic view showing a power system of the work vehicle according to the first embodiment.

The work vehicle 100 includes an engine 210, a power take off 220 (PTO), a transmission 230, a front axle 240, a rear axle 250, a variable capacity pump 260, and a brake pump 270.

The PTO 220 transmits a part of the driving force of the engine 210 to the variable capacity pump 260. That is, the PTO 220 distributes the driving force of the engine 210 to the transmission 230 and the variable capacity pump 260.

The transmission 230 shifts the driving force input to an input shaft, and outputs the driving force from an output shaft. The input shaft of the transmission 230 is connected to the PTO 220, and the output shaft of the transmission 230 is connected to the front axle 240 and the rear axle 250. That is, the transmission 230 transmits the driving force of the engine 210 which is distributed by the PTO 220 to the front axle 240 and the rear axle 250. An output shaft of the transmission 230 is provided with a tachometer 231 for measuring the rotation speed. The rotation speed of the output shaft is used to obtain the vehicle speed of the work vehicle 100.

The front axle 240 transmits the driving force output by the transmission 230 to the front wheel part 130. In this manner, the front wheel part 130 is rotated.

The rear axle 250 transmits the driving force output by the transmission 230 to the rear wheel part 140. In this manner, the rear wheel part 140 is rotated.

The variable capacity pump 260 is driven by a driving force transmitted from the engine 210. The hydraulic oil discharged from the variable capacity pump 260 is supplied to the lift cylinder 124 and the bucket cylinder 125 via a control valve 261, and is supplied to the steering cylinder 113 via a steering valve 262. In addition, the hydraulic oil discharged from the variable capacity pump 260 is ejected via a relief valve 266.

The control valve 261 controls a flow rate of the hydraulic oil discharged from the variable capacity pump 260, and distributes the hydraulic oil to the lift cylinder 124 and the bucket cylinder 125. The steering valve 262 controls the flow rate of the hydraulic oil supplied to the steering cylinder 113. The relief valve 266 releases a pressure of the hydraulic oil when the pressure exceeds a predetermined relief pressure, and ejects the hydraulic oil.

The lift cylinder 124 is provided with a cylinder pressure gauge 264. The cylinder pressure gauge 264 measures the bottom pressure of the lift cylinder 124.

The brake pump 270 is a fixed capacity pump driven by the driving force transmitted from the engine 210. The hydraulic oil discharged from the brake pump 270 is supplied to the brake valve 271. The brake valve 271 controls the pressure of the hydraulic oil supplied to a brake cylinder (not shown) built in each axle. When the hydraulic oil is supplied to the brake cylinder, a brake disc rotating together with the rotary shafts of the front wheel part 130 and the rear wheel part 140 is pressed against a non-rotating plate, and a braking force is generated.

Control Device

The work vehicle 100 includes a control device 300 for controlling the work vehicle 100.

The control device 300 outputs a control signal to the control valve 261 in accordance with a stage of the automatic excavation control.

Figure 4:
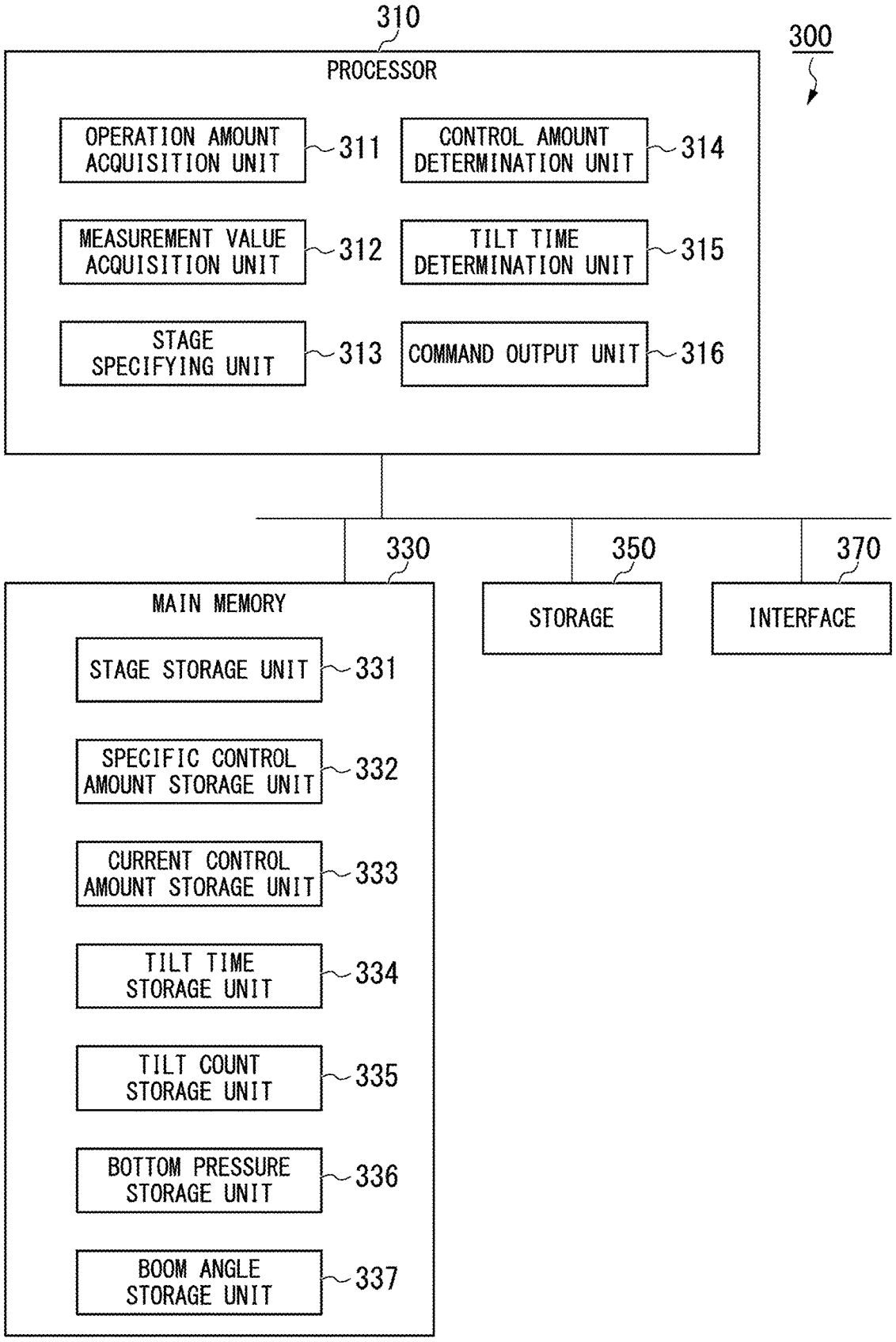
FIG. 4 is a schematic block diagram showing a configuration of a control device for the work vehicle according to the first embodiment.

FIG. 4 is a schematic block diagram showing a configuration of the control device for the work vehicle according to the first embodiment. The control device 300 is a computer including a processor 310, a main memory 330, a storage 350, and an interface 370.

The storage 350 is a non-transitory tangible storage medium. Examples of the storage 350 include a hard disk drive (HDD), a solid state drive (SSD), a magnetic disc, a magneto-optical disc, a compact disc read only memory (CD-ROM), and a digital versatile disc read only memory (DVD-ROM), and a semiconductor memory. The storage 350 may be an internal medium directly connected to a bus of the control device 300, or may be an external medium connected to the control device 300 via the interface 370 or a communication line. The storage 350 stores a program for controlling the work vehicle 100.

The program may partially realize functions of the control device 300. For example, the program may fulfill a function in combination with another program previously stored in the storage or in combination with another program installed in another device. In another embodiment, the computer may include a custom large scale integrated circuit (LSI) such as a programmable logic device (PLD) in addition to the above-described configuration or instead of the above-described configuration. Examples of the PLD include a programmable array logic (PAL), a generic array logic (GAL), a complex programmable logic device (CPLD), and a field programmable gate array (FPGA). In this case, functions realized by the processor may be partially or entirely realized by the integrated circuit.

In a case where the program is distributed to the control device 300 via a communication line, the control device 300 receiving the distribution may deploy the program in the main memory 330, and may execute the above-described process.

In addition, the program may partially realize the above-described function. Furthermore, the program may be a so-called difference file (difference program) that realizes the above-described function in combination with another program previously stored in the storage 350.

The processor 310 executes the program and includes an operation amount acquisition unit 311, a measurement value acquisition unit 312, a stage specifying unit 313, a control amount determination unit 314, a tilt time determination unit 315, and a command output unit 316.

In addition, the program is executed such that the main memory 330 secures each storage region of a stage storage unit 331, a specific control amount storage unit 332, a current control amount storage unit 333, a tilt time storage unit 334, a tilt count storage unit 335, a bottom pressure storage unit 336, and a boom angle storage unit 337.

The operation amount acquisition unit 311 acquires an operation amount from each of the accelerator pedal 152, the front/rear selection switch 155, the boom lever 157, the bucket lever 158, and the automatic excavation switch 159.

The measurement value acquisition unit 312 acquires measurement values from the tachometer 231, the lift stroke sensor 1241, the bucket stroke sensor 1251, and the cylinder pressure gauge 264. That is, the measurement value acquisition unit 312 acquires measurement values of a rotation speed of the output shaft of the transmission 230, a stroke amount of the lift cylinder 124, a stroke amount of the bucket cylinder 125, and a bottom pressure of the lift cylinder 124. The bottom pressure of the lift cylinder 124 indicates a lift force as a force which the lift cylinder 124 receives from the boom 121. That is, the measurement value acquisition unit 312 is an example of a lift force detection unit.

The stage specifying unit 313 specifies a stage of the automatic excavation control performed by the control device 300, based on an operation amount, a measurement value, and a value stored in the main memory 330. The stage specifying unit 313 stores the specified stage in the stage storage unit 331.

Figure 5:
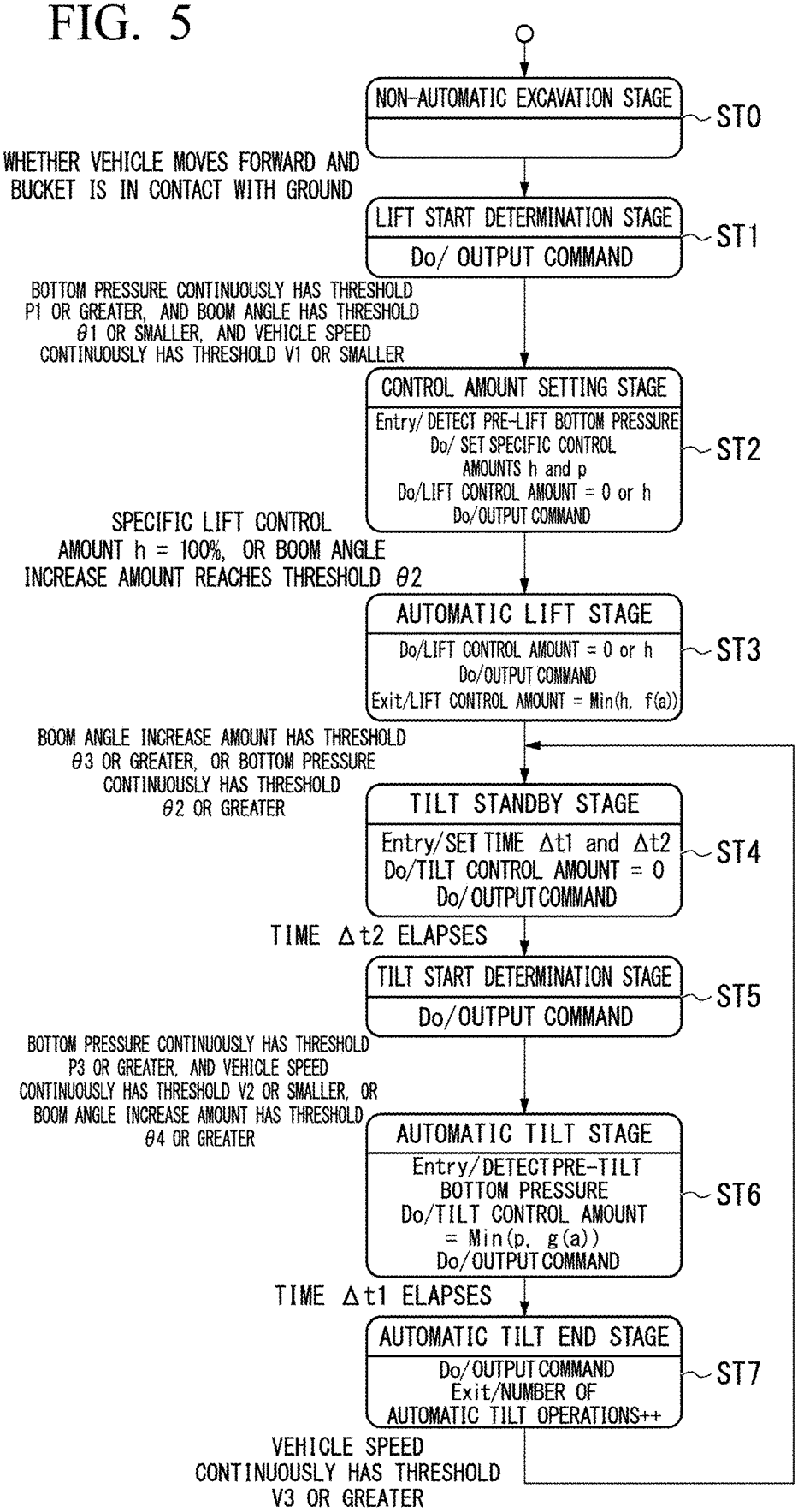
FIG. 5 is a state transition diagram showing a transition of stages of automatic excavation control according to the first embodiment.

FIG. 5 is a state transition diagram showing a transition of the stages of the automatic excavation control according to the first embodiment. The stages of the automatic excavation control are eight stage including a non-automatic excavation stage ST0, a lift start determination stage ST1, a control amount setting stage ST2, an automatic lift stage ST3, a tilt standby stage ST4, a tilt start determination stage ST5, an automatic tilt stage ST6, and an automatic tilt end stage ST7.

The control amount determination unit 314 determines a specific lift control amount h and a specific tilt control amount p in the automatic excavation control, based on the measurement value of the bottom pressure of the lift cylinder 124 which is acquired by the measurement value acquisition unit 312, when the automatic excavation control is in the control amount setting stage ST2. The specific lift control amount h and the specific tilt control amount p monotonically increase with respect to the bottom pressure. In the present embodiment, the description of "monotonically increasing" means that when one value increases, the other value always increases, or is not changed (does not monotonically decrease). The control amount determination unit 314 stores the determined specific lift control amount h and the determined specific tilt control amount p in the specific control amount storage unit 332.

The specific lift control amount h is a value set as a lift control amount when a lift operation is performed in the automatic excavation control. The specific tilt control amount p is a value set as the tilt control amount when a tilt operation is performed in the automatic excavation control.

Figure 6:
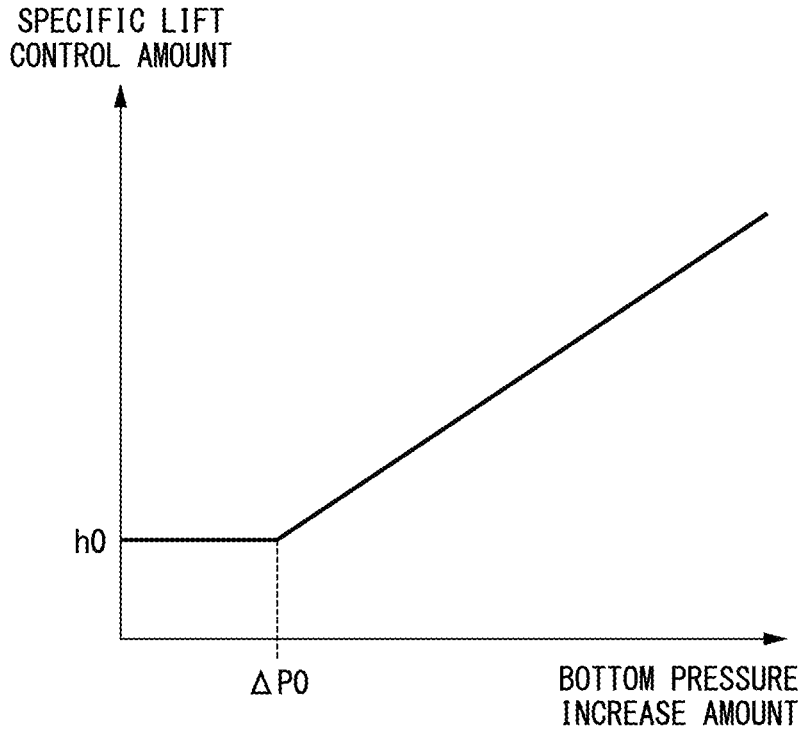
FIG. 6 shows an example of a lift control amount determination function according to the first embodiment.

Specifically, the control amount determination unit 314 determines the specific lift control amount h by substituting a bottom pressure increase amount into a lift control amount determination function that indicates a relationship between a bottom pressure increase amount and the specific lift control amount. FIG. 6 is an example of the lift control amount determination function according to the first embodiment. In the lift control amount determination function, when the bottom pressure increase amount is equal to or smaller than a threshold ΔP1, the specific lift control amount h has a predetermined lower limit value h0. The lower limit value h0 of the specific lift control amount h is a value greater than 0. In the lift control amount determination function, when the bottom pressure increase amount is greater than the threshold ΔP1, the specific lift control amount h increases in proportion to the bottom pressure increase amount.

Figure 7:
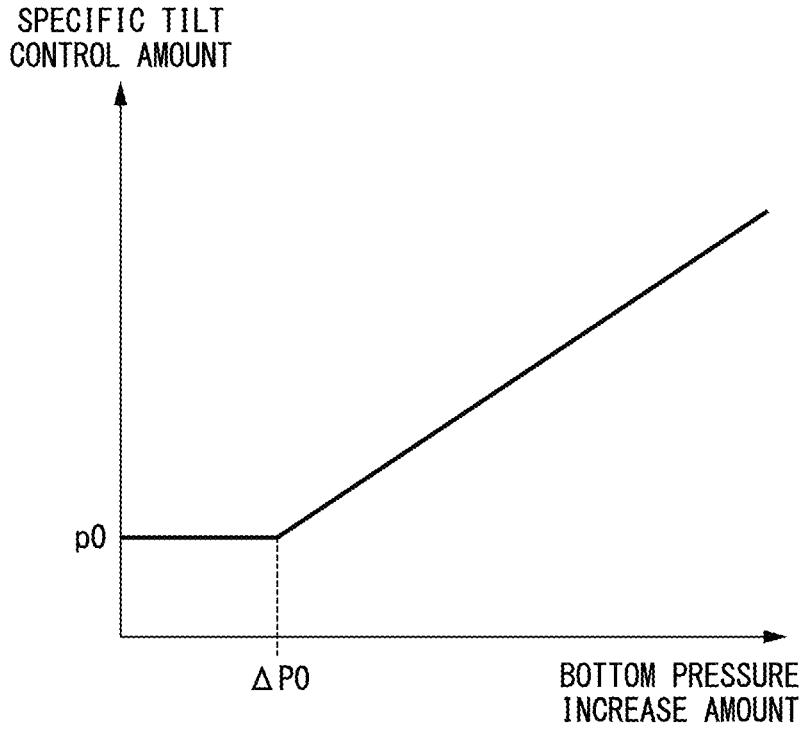
FIG. 7 shows an example of a tilt control amount determination function according to the first embodiment.

Specifically, the control amount determination unit 314 determines the specific tilt control amount p by substituting the bottom pressure increase amount into the tilt control amount determination function that indicates the relationship between the bottom pressure increase amount and the specific tilt control amount p. FIG. 7 is an example of the tilt control amount determination function according to the first embodiment. In the tilt control amount determination function, when the bottom pressure increase amount is equal to or smaller than a threshold ΔPt, the specific tilt control amount p has a predetermined lower limit value p0. The lower limit value p0 of the specific tilt control amount is a value greater than 0. In the tilt control amount determination function, when the bottom pressure increase amount is greater than the threshold ΔPt, the specific tilt control amount p increases in proportion to the bottom pressure increase amount.

In another embodiment, the lift control amount determination function or the tilt control amount determination function may indicate a relationship between the absolute value of the bottom pressure and the specific lift control amount h or the specific tilt control amount p. In this case, the control amount determination unit determines the specific lift control amount h and the specific tilt control amount p, based on the absolute value of the bottom pressure.

In addition, the control amount determination unit 314 rewrites the lift control amount and the tilt control amount which are stored in the current control amount storage unit 333, in accordance with the stage of the automatic excavation control. Initial values of the lift control amount and the tilt control amount which are stored in the current control amount storage unit 333 are both 0.

The tilt time determination unit 315 determines a tilt-ON time Δt1 and a tilt-OFF time Δt2, based on the number of tilt operations stored in the tilt count storage unit 335. In the automatic excavation control according to the first embodiment, the bucket 122 intermittently performs the tilt operation. The ON time and OFF time of the tilt operation at this time are determined by the tilt time determination unit 315. The tilt-ON time Δt1 and the tilt-OFF time Δt2 are set in advance in accordance with the number of tilt operations.

The command output unit 316 outputs a control command to the control valve 261, based on the operation amount acquired by the operation amount acquisition unit 311 and the control amount stored in the current control amount storage unit 333. Specifically, the command output unit 316 outputs a control command of the lift cylinder 124 to the control valve 261, based on the operation amount of the boom lever 157 which is acquired by the operation amount acquisition unit 311 and the lift control amount stored in the current control amount storage unit 333. In addition, the command output unit 316 outputs a control command of the bucket cylinder 125 to the control valve 261, based on the operation amount of the bucket lever 158 which is acquired by the operation amount acquisition unit 311 and the tilt control amount stored in the current control amount storage unit 333.

Automatic Excavation Control

The automatic excavation control according to the first embodiment will be described with reference to the state transition diagram shown in FIG. 5. In the automatic excavation control according to the first embodiment, as shown in FIG. 5, the stages of the automatic excavation control are distinguished from each other in eight stages.

When the automatic excavation control is enabled by an operator pressing the automatic excavation switch 159, the stage specifying unit 313 of the control device 300 specifies that the stage of the automatic excavation control is the non-automatic excavation stage ST0. The stage specifying unit 313 rewrites the state stored in the stage storage unit 331 to the non-automatic excavation stage ST0.

Non-Automatic Excavation Stage ST0

When the stage of the automatic excavation control is the non-automatic excavation stage ST0, the stage specifying unit 313 determines whether or not the work vehicle 100 moves forward and the bucket 122 is in contact with the ground, based on the operation amount acquired by the operation amount acquisition unit 311 and the measurement value acquired by the measurement value acquisition unit 312. For example, the stage specifying unit 313 determines that the work vehicle 100 moves forward, when the accelerator pedal 152 is stepped on and the front/rear selection switch 155 is set to F (Front). In addition, for example, the stage specifying unit 313 specifies the boom angle $\theta_L$ and the bucket angle $\theta_B$, based on detection values of the lift stroke sensor 1241 and the bucket stroke sensor 1251. When the boom angle $\theta_L$ is equal to or smaller than a predetermined threshold and the bucket angle $\theta_B$ is within a predetermined range including 0 degrees, the stage specifying unit 313 determines that the bucket 122 is in contact with the ground. For example, whether or not the work vehicle 100 moves forward may be determined, based on the vehicle speed obtained from the measurement value of the tachometer 231.

When the stage of the automatic excavation control is the non-automatic excavation stage ST0, and when the work vehicle 100 moves forward and the bucket 122 is in contact with the ground, the stage specifying unit 313 specifies that the stage of the automatic excavation control is the lift start determination stage ST1. The stage specifying unit 313 rewrites a state stored in the stage storage unit 331 to the lift start determination stage ST1.

On the other hand, when the stage of the automatic excavation control is the non-automatic excavation stage ST0, and when the work vehicle 100 does not move forward or the bucket 122 is not in contact with the ground, the stage specifying unit 313 specifies that the stage of the automatic excavation control is the non-automatic excavation stage ST0. In the non-automatic excavation stage ST0, the command output unit 316 outputs a lift control command in accordance with the operation amount of the boom lever 157 and a tilt control command in accordance with the operation amount of the bucket lever 158, to the control valve 261. That is, in the non-automatic excavation stage ST0, work machine control is manually operated.

Lift Start Determination Stage ST1

Figure 8:
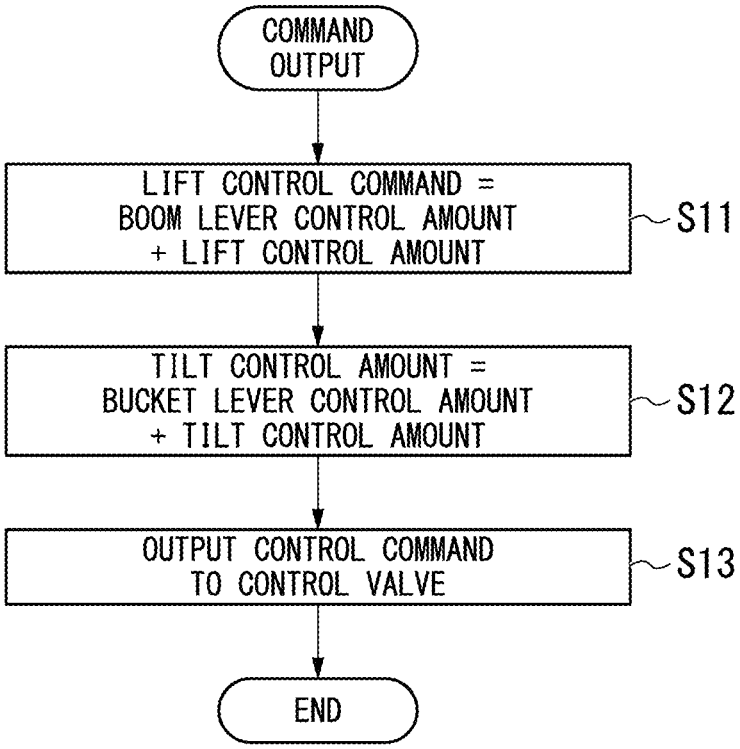
FIG. 8 is a flowchart showing a command output process according to the first embodiment.

When the stage of the automatic excavation control is the lift start determination stage ST1, the command output unit 316 performs a command output process. FIG. 8 is a flowchart showing the command output process according to the first embodiment.

The command output unit 316 generates a lift control command indicating the control amount according to a sum of the control amount based on the operation amount of the boom lever 157 which is acquired by the operation amount acquisition unit 311 and the lift control amount stored in the current control amount storage unit 333 (Step S11). In addition, the command output unit 316 generates a tilt control command indicating the control amount according to a sum of the control amount based on the operation amount of the bucket lever 158 which is acquired by the operation amount acquisition unit 311 and the tilt control amount stored in the current control amount storage unit 333 (Step S12).

The command output unit 316 outputs the generated lift control command and the generated tilt control command to the control valve 261 (Step S13).

In the lift start determination stage ST1, the lift control amount and the tilt control amount which are stored in the current control amount storage unit 333 are both 0.

In addition, when the stage of the automatic excavation control is the lift start determination stage ST1, the stage specifying unit 313 determines, based on the measurement value acquired by the measurement value acquisition unit 312, whether or not the bottom pressure of the lift cylinder 124 continuously has a threshold P1 or greater for a certain period of time, the boom angle has a threshold θ1 or smaller, and the vehicle speed continuously has a threshold V1 or smaller for a certain period of time.

The threshold P1 of the bottom pressure is set to a value such that the bottom pressure is detected when the bucket 122 enters an excavation object. That is, it can be recognized that the bucket 122 is in a state of entering the excavation object, by detecting that the bottom pressure of the lift cylinder 124 continuously has the threshold P1 or greater for a certain period of time.

When the stage of the automatic excavation control is the lift start determination stage ST1, and when the bottom pressure of the lift cylinder 124 continuously has the threshold P1 or greater for a certain period of time, the boom angle has the threshold θ1 or smaller, and the vehicle speed continuously has the threshold V1 or smaller for a certain period of time, the stage specifying unit 313 specifies that the stage of the automatic excavation control is the control amount setting stage ST2. The stage specifying unit 313 rewrites a state stored in the stage storage unit 331 to the control amount setting stage ST2.

On the other hand, when the stage of the automatic excavation control is the lift start determination stage ST1, when the bottom pressure of the lift cylinder 124 has a value smaller than the threshold P1 within a certain period of time, when the boom angle has a value greater than the threshold θ1, or when the vehicle speed has a value greater than the threshold V1 within a certain period of time, the stage specifying unit 313 specifies that the stage of the automatic excavation control is the lift start determination stage ST1.

Control Amount Setting Stage ST2

When the stage of the automatic excavation control transitions from the lift start determination stage ST1 to the control amount setting stage ST2, the measurement value acquisition unit 312 causes the bottom pressure storage unit 336 to store the bottom pressure measured by the cylinder pressure gauge 264 as a pre-lift bottom pressure. In addition, the measurement value acquisition unit 312 causes the bottom pressure storage unit 336 to store 0 as an initial value of the bottom pressure increase amount.

In addition, the measurement value acquisition unit 312 causes the boom angle storage unit 337 to store the boom angle $\theta_L$ obtained from the measurement value of the lift stroke sensor 1241, as a pre-lift boom angle.

Figure 9:
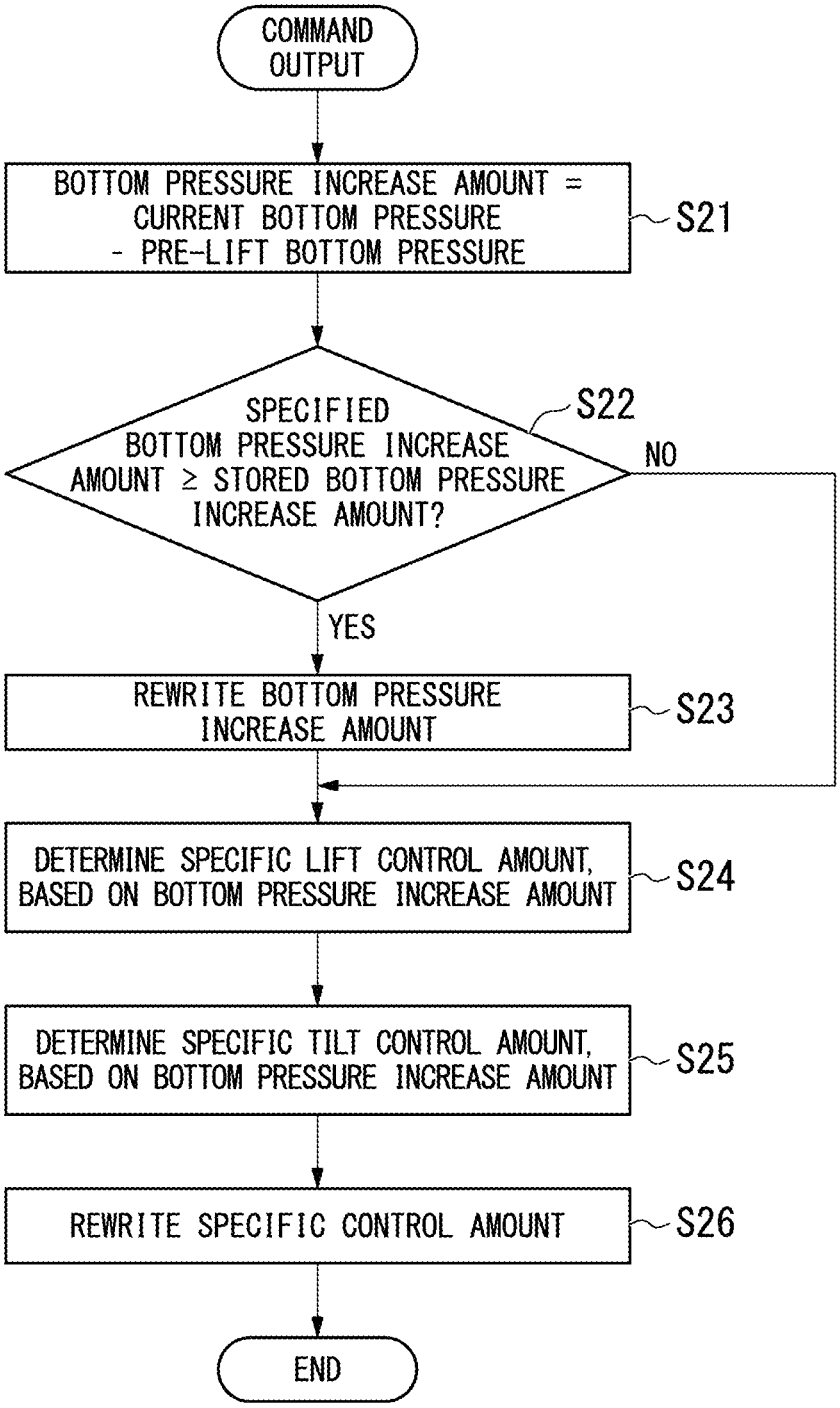
FIG. 9 is a flowchart showing a specific control amount setting process according to the first embodiment.

When the stage of the automatic excavation control is the control amount setting stage ST2, the command output unit 316 performs a specific control amount setting process. FIG. 9 is a flowchart showing the specific control amount setting process according to the first embodiment. The control amount determination unit 314 specifies, as the bottom pressure increase amount, the difference between the measurement value of the bottom pressure of the lift cylinder 124 which is acquired by the measurement value acquisition unit 312 and the pre-lift bottom pressure stored in the bottom pressure storage unit 336 (Step S21). The control amount determination unit 314 determines whether or not the specified bottom pressure increase amount is equal to or larger than the bottom pressure increase amount stored in the bottom pressure storage unit 336 (Step S22). When the specified bottom pressure increase amount is equal to or larger than the bottom pressure increase amount stored in the bottom pressure storage unit 336 (Step S22: YES), the control amount determination unit 314 rewrites the bottom pressure increase amount stored in the bottom pressure storage unit 336 to the bottom pressure increase amount specified in Step S21 (Step S23).

When the specified bottom pressure increase amount is smaller than the bottom pressure increase amount stored in the bottom pressure storage unit 336 (Step S22: NO), or when the bottom pressure increase amount stored in the bottom pressure storage unit 336 is rewritten, the control amount determination unit 314 determines the specific lift control amount h by substituting the bottom pressure increase amount stored in the bottom pressure storage unit 336 into the lift control amount determination function shown in FIG. 6 (Step S24). In addition, the control amount determination unit 314 determines the specific tilt control amount p by substituting the bottom pressure increase amount stored in the bottom pressure storage unit 336 into the tilt control amount determination function shown in FIG. 7 (Step S25).

The control amount determination unit 314 rewrites the specific lift control amount h stored in the specific control amount storage unit 332 to the specific lift control amount h determined in Step S24. In addition, the control amount determination unit 314 rewrites the specific tilt control amount p stored in the specific control amount storage unit 332 to the specific tilt control amount p determined in Step S25 (Step S26).

Next, the control amount determination unit 314 determines the lift control amount, based on the operation amount of the boom lever 157. Specifically, the control amount determination unit 314 determines whether or not the operation amount of the boom lever 157 which is acquired by the operation amount acquisition unit 311 continuously indicates neutrality for a predetermined time. When the operation amount of the boom lever 157 continuously indicates the neutrality for a predetermined time, the control amount determination unit 314 rewrites the lift control amount stored in the current control amount storage unit 333 to the specific lift control amount h stored in the specific control amount storage unit 332. On the other hand, when the operation amount of the boom lever 157 indicates a non-neutral value within a predetermined time, the control amount determination unit 314 rewrites the lift control amount stored in the current control amount storage unit 333 to 0. That is, when the boom lever 157 is operated by the operator, the lift control amount is set to 0 to give priority to the operation of the operator.

Next, the command output unit 316 performs a command output process shown in FIG. 8. In the control amount setting stage ST2, the lift control amount stored in the current control amount storage unit 333 is the specific lift control amount h set in the specific control amount setting process when the boom lever 157 is not operated, and is 0 when the boom lever 157 is operated. On the other hand, the tilt control amount stored in the current control amount storage unit 333 is 0.

In addition, when the stage of the automatic excavation control is the control amount setting stage ST2, the stage specifying unit 313 determines whether or not the specific lift control amount h stored in the specific control amount storage unit 332 reaches 100%, or whether or not the difference (boom angle increase amount) between the current boom angle $\theta_L$ and the boom angle stored in the boom angle storage unit 337 reaches a threshold θ2.

When the stage of the automatic excavation control is the control amount setting stage ST2, and when the specific lift control amount h reaches 100%, or the boom angle increase amount reaches the threshold θ2, the stage specifying unit 313 specifies that the stage of the automatic excavation control is the automatic lift stage ST3. The stage specifying unit 313 rewrites a state stored in the stage storage unit 331 to the automatic lift stage ST3.

The specific lift control amount h and the specific tilt control amount p are not rewritten in a stage after the control amount setting stage ST2.

On the other hand, when the stage of the automatic excavation control is the control amount setting stage ST2, and when the specific lift control amount h is smaller than 100%, and the boom angle increase amount is smaller than the threshold θ2, the stage specifying unit 313 specifies that the stage of the automatic excavation control is the control amount setting stage ST2.

Automatic Lift Stage ST3

When the stage of the automatic excavation control is the automatic lift stage ST3, the control amount determination unit 314 determines the lift control amount, based on the operation amount of the boom lever 157, as in the control amount setting stage ST2.

Next, the command output unit 316 performs a command output process shown in FIG. 8. In the automatic lift stage ST3, the lift control amount stored in the current control amount storage unit 333 is the specific lift control amount h when the boom lever 157 is not operated, and is 0 when the boom lever 157 is operated. On the other hand, the tilt control amount stored in the current control amount storage unit 333 is 0.

In addition, when the stage of the automatic excavation control is the automatic lift stage ST3, the stage specifying unit 313 determines whether or not the boom angle increase amount with respect to the pre-lift boom angle stored in the boom angle storage unit 337 has a threshold θ3 or greater, or the bottom pressure of the lift cylinder 124 continuously has a threshold P2 or greater. The threshold θ3 is greater than the threshold θ2.

When the stage of the automatic excavation control is the automatic lift stage ST3, and when the boom angle increase amount has the threshold θ3 or greater, or the bottom pressure of the lift cylinder 124 continuously has the threshold P2 or greater for a certain period of time, the stage specifying unit 313 specifies that the stage of the automatic excavation control is the tilt standby stage ST4. The stage specifying unit 313 rewrites a state stored in the stage storage unit 331 to the tilt standby stage ST4.

On the other hand, when the stage of the automatic excavation control is the automatic lift stage ST3, and when the boom angle increase amount is smaller than the threshold θ3, and the bottom pressure of the lift cylinder 124 has a value smaller than the threshold P2 within a certain period of time, the stage specifying unit 313 specifies that the stage of the automatic excavation control is the automatic lift stage ST3.

When the stage of the automatic excavation control transitions from the automatic lift stage ST3 to the tilt standby stage ST4, the control amount determination unit 314 calculates the lift control amount by substituting the operation amount of the accelerator pedal 152 into a lift accelerator function f(a) that indicates a relationship between the operation amount of the accelerator pedal 152 and the lift control amount. The lift accelerator function f(a) is a function in which the lift control amount monotonically increases with respect to an operation amount a of the accelerator pedal. In the lift accelerator function f(a), even when a pressing amount a of the accelerator pedal 152 is 0, the lift control amount has a value greater than 0. The control amount determination unit 314 rewrites the lift control amount stored in the current control amount storage unit 333 to a smaller one between the lift control amount calculated based on the lift accelerator function f(a) and the specific lift control amount h stored in the specific control amount storage unit 332. That is, after the tilt standby stage ST4, the lift control amount has a value greater than 0, and has a value equal to or smaller than the specific lift control amount h. The lift control amount is not fixed by the operation amount of the accelerator pedal 152 at a moment of the transition from the automatic lift stage ST3 to the tilt standby stage ST4, and varies depending on the operation amount of the accelerator pedal 152 even after the transition to the tilt standby stage ST4. In this manner, the operator can control the speed of automatic excavation in accordance with the pressing amount of the accelerator pedal 152.

Tilt Standby Stage ST4

When the stage of the automatic excavation control transitions from the automatic lift stage ST3 to the tilt standby stage ST4, the tilt time determination unit 315 determines a tilt-ON time Δt1 and a tilt-OFF time Δt2, based on the number of automatic tilt operations stored in the tilt count storage unit 335. In addition, the measurement value acquisition unit 312 causes the boom angle storage unit 337 to store, as a standby start boom angle, the boom angle $\theta_L$ obtained from the measurement value of the lift stroke sensor 1241.

When the stage of the automatic excavation control is the tilt standby stage ST4, the control amount determination unit 314 sets the tilt control amount to 0.

Next, the command output unit 316 performs a command output process shown in FIG. 8. In the tilt standby stage ST4, the lift control amount stored in the current control amount storage unit 333 has a value greater than 0, and equal to or smaller than the specific lift control amount h, in accordance with the pressing amount of the accelerator pedal 152. On the other hand, the tilt control amount stored in the current control amount storage unit 333 is 0.

In addition, when the stage of the automatic excavation control is the tilt standby stage ST4, the stage specifying unit 313 determines whether or not an elapsed time from when the stage of the automatic excavation control transitions from the automatic lift stage ST3 to the tilt standby stage ST4 reaches the tilt-OFF time Δt2.

When the stage of the automatic excavation control is the tilt standby stage ST4, and when the elapsed time from when the stage of the automatic excavation control transitions from the automatic lift stage ST3 to the tilt standby stage ST4 reaches the tilt-OFF time Δt2, the stage specifying unit 313 specifies that the stage of the automatic excavation control is the tilt start determination stage ST5. The stage specifying unit 313 rewrites a state stored in the stage storage unit 331 to the tilt start determination stage ST5.

On the other hand, when the stage of the automatic excavation control is the tilt standby stage ST4, and when the elapsed time from the transition to the tilt standby stage ST4 is shorter than the tilt-OFF time Δt2, the stage specifying unit 313 specifies that the stage of the automatic excavation control is the tilt standby stage ST4.

Tilt Start Determination Stage ST5

When the stage of the automatic excavation control is the tilt start determination stage ST5, the command output unit 316 performs a command output process shown in FIG. 8. In the tilt start determination stage ST5, the lift control amount stored in the current control amount storage unit 333 has a value greater than 0, and equal to or smaller than the specific lift control amount h, in accordance with the pressing amount of the accelerator pedal 152. On the other hand, the tilt control amount stored in the current control amount storage unit 333 is 0.

In addition, when the stage of the automatic excavation control is the tilt start determination stage ST5, the stage specifying unit 313 determines whether or not the bottom pressure of the lift cylinder 124 continuously has a threshold P3 or greater for a certain period of time, and the vehicle speed continuously has a threshold V2 or smaller for a certain period of time. In addition, the stage specifying unit 313 determines whether or not the boom angle increase amount from a standby start boom angle stored in the boom angle storage unit 337 has a threshold θ4 or greater.

When the stage of the automatic excavation control is the tilt start determination stage ST5, and when the bottom pressure of the lift cylinder 124 continuously has the threshold P3 or greater for a certain period of time, and the vehicle speed continuously has the threshold V2 or smaller for a certain period of time, or when the boom angle increase amount has the threshold θ4 or greater, the stage specifying unit 313 specifies that the stage of the automatic excavation control is the automatic tilt stage ST6. The stage specifying unit 313 rewrites a state stored in the stage storage unit 331 to the automatic tilt stage ST6.

On the other hand, when the stage of the automatic excavation control is the tilt start determination stage ST5, and when the boom angle increase amount has a value smaller than the threshold θ4 and the bottom pressure of the lift cylinder 124 has a value smaller than the threshold P3 within a certain period of time, or when the boom angle increase amount has a value smaller than the threshold θ4 and the vehicle speed has a value greater than the threshold V2 within a certain period of time, the stage specifying unit 313 specifies that the stage of the automatic excavation control is the tilt start determination stage ST5.

Automatic Tilt Stage ST6

When the stage of the automatic excavation control transitions from the tilt start determination stage ST5 to the automatic tilt stage ST6, the measurement value acquisition unit 312 causes the bottom pressure storage unit 336 to store the bottom pressure measured by the cylinder pressure gauge 264, as a pre-tilt bottom pressure.

When the stage of the automatic excavation control is the automatic tilt stage ST6, the control amount determination unit 314 calculates the tilt control amount by substituting the operation amount of the accelerator pedal 152 into a tilt accelerator function g(a) indicating a relationship between the operation amount a of the accelerator pedal 152 and the tilt control amount. The tilt accelerator function g(a) is a function in which the tilt control amount monotonically increases with respect to the operation amount a of the accelerator pedal. In the tilt accelerator function g (a), the tilt control amount has a value greater than 0, even when the pressing amount a of the accelerator pedal 152 is 0. The control amount determination unit 314 rewrites the tilt control amount stored in the current control amount storage unit 333 to a smaller amount between the tilt control amount calculated based on the tilt accelerator function g(a) and the specific tilt control amount p stored in the specific control amount storage unit 332. That is, in the automatic tilt stage, the tilt control amount has a value greater than 0, and equal to or smaller than the specific tilt control amount p.

Next, the command output unit 316 performs a command output process shown in FIG. 8. In the automatic tilt stage ST6, the lift control amount stored in the current control amount storage unit 333 has a value greater than 0, and equal to or smaller than the specific lift control amount h, in accordance with the pressing amount of the accelerator pedal 152. In addition, the tilt control amount stored in the current control amount storage unit 333 has a value greater than 0, and equal to or smaller than the specific tilt control amount p, in accordance with the pressing amount of the accelerator pedal 152.

In addition, when the stage of the automatic excavation control is the automatic tilt stage ST6, the stage specifying unit 313 determines whether or not the elapsed time from when the stage of the automatic excavation control transitions from the tilt start determination stage ST5 to the automatic tilt stage ST6 reaches the tilt-ON time Δt1.

When the stage of the automatic excavation control is the automatic tilt stage ST6, and when the elapsed time from when the stage of the automatic excavation control transitions from the tilt start determination stage ST5 to the automatic tilt stage ST6 reaches the tilt-ON time Δt1, the stage specifying unit 313 specifies that the stage of the automatic excavation control is the automatic tilt end stage ST7. The stage specifying unit 313 rewrites a state stored in the stage storage unit 331 to the automatic tilt end stage ST7.

On the other hand, when the stage of the automatic excavation control is the automatic tilt stage ST6, and when the elapsed time from when the stage of the automatic excavation control transitions from the tilt start determination stage ST5 to the automatic tilt stage ST6 is shorter than the tilt-ON time Δt1, the stage specifying unit 313 specifies that the stage of the automatic excavation control is the automatic tilt stage ST6.

Automatic Tilt End Stage ST7

When the stage of the automatic excavation control is the automatic tilt end stage ST7, the stage specifying unit 313 determines whether or not the bottom pressure increase amount from the pre-tilt bottom pressure stored in the bottom pressure storage unit 336 has a threshold ΔP1 or greater. In addition, the stage specifying unit 313 determines whether or not the vehicle speed continuously has a threshold V3 or greater for a certain period of time.

When the stage of the automatic excavation control is the automatic tilt end stage ST7, and when the vehicle speed continuously has the threshold V3 or greater for a certain period of time, the stage specifying unit 313 specifies that the stage of the automatic excavation control is the tilt standby stage ST4.

The stage specifying unit 313 rewrites a state stored in the stage storage unit 331 to the tilt standby stage ST4.

On the other hand, when the stage of the automatic excavation control is the automatic tilt end stage ST7, and when the vehicle speed has a value smaller than the threshold V3 within a certain period of time, the stage specifying unit 313 specifies that the stage of the automatic excavation control is the automatic tilt end stage ST7.

When the stage of the automatic excavation control does not transition from the automatic tilt end stage ST7 to the tilt standby stage ST4, the command output unit 316 performs a command output process shown in FIG. 8. In the automatic tilt end stage ST7, the lift control amount stored in the current control amount storage unit 333 has a value greater than 0, and equal to or smaller than the specific lift control amount h, in accordance with the pressing amount of the accelerator pedal 152. On the other hand, the tilt control amount stored in the current control amount storage unit 333 has a value greater than 0, and equal to or smaller than the specific tilt control amount p, in accordance with the pressing amount of the accelerator pedal 152.

When the stage of the automatic excavation control transitions from the automatic tilt end stage ST7 to the tilt standby stage ST4, the stage specifying unit 313 increments the number of automatic tilt operations stored in the tilt count storage unit 335.

End Condition of Automatic Excavation Control

The automatic excavation control according to the first embodiment ends when any one of the following end conditions (1) to (8) is satisfied.

The automatic excavation switch 159 is operated such that the automatic excavation is disabled.

(2) The traveling direction is no longer the forward movement direction.

(3) A predetermined time elapses after the bucket 122 reaches a tilt end.

(4) The boom angle is equal to or larger than a predetermined angle.

(5) The work machine 120 is locked.

(6) A problem occurs in the sensor or the operation device of the work machine 120.

(7) The lowering operation of the boom 121 is performed by the boom lever 157, and the operation amount is larger than a predetermined amount.

(8) A dump operation of the bucket 122 is performed by the bucket lever 158, and the operation amount is larger than a predetermined amount.

The control device 300 ends the automatic excavation control when any one of the above-described end conditions is satisfied, even when the stage of the automatic excavation control is any stage.

Operational Effect

In this way, according to the first embodiment, the control device 300 determines the lift control amount for the work machine 120, based on the change amount of the lift force of the work machine 120.

In the excavation control performed by the work machine 120, after the work machine 120 enters the excavation object, the work machine 120 is lifted to apply a load to the front wheel part 130. In this manner, digging work can be continuously carried out while preventing tire slippage. Here, when the work machine 120 cannot sufficiently enter the excavation object since the excavation object is hard, or the excavation object is light, and when the lift control amount is excessively large, the bucket 122 fails the excavation, thereby causing a possibility that sufficient loading work for the excavation object may not be realized. On the other hand, when the lift control amount is excessively small, there is a possibility that the work machine 120 may not be sufficiently pushed into the excavation object due to occurrence of the tire slippage or an insufficient traction force. In contrast, the control device 300 according to the first embodiment determines the lift control amount for the work machine 120, based on the change amount of the lift force of the work machine 120. In this manner, in accordance with a state of the excavation object, the control device 300 can perform the excavation control while preventing the failure of the bucket 122 in the excavation and the occurrence of the tire slippage.

In addition, according to the first embodiment, the control device 300 determines the tilt control amount for the work machine 120, based on the change amount of the lift force of the work machine 120.

In the excavation control performed by the work machine 120, the excavation object is held by tilting the bucket 122 during the excavation performed by the work machine 120. Here, when an angle of repose of the excavation object is gentle and the tilt control amount is excessively large, the bucket 122 may fail the excavation, thereby causing a possibility that sufficient loading work for the excavation object may not be realized. On the other hand, when the tilt control amount is too small, there is a possibility that the excavation object may not sufficiently be held.

It is assumed that the amount of the excavation object entering the bucket 122 decreases as the angle of repose of the excavation object decrease. Therefore, it is assumed that the lift force decreases as the angle of repose decrease.

Therefore, the control device 300 according to the first embodiment determines the tilt control amount for the work machine 120, based on the change amount of the lift force of the work machine 120. In this manner, in accordance with a state of the excavation object, the control device 300 can perform the excavation control while preventing the failure of the bucket 122 in the excavation and the occurrence of the tire slippage.

ANOTHER EMBODIMENT

Hitherto, the embodiment has been described in detail with reference to the drawings. However, the specific configuration is not limited to the above-described embodiment, and various design changes can be made.

For example, the control device 300 according to the first embodiment determines the lift control amount and the tilt control amount, based on the change amount of the lift force of the work machine 120. However, the configuration is not limited thereto. For example, the control device 300 according to another embodiment may determine either the lift control amount or the tilt control amount, based on the lift force.

In addition, in the control amount setting stage ST2, the control device 300 according to the first embodiment determines the specific lift control amount h and the specific tilt control amount p by changing the lift control amount with a constant modulation according to the lift control amount determination function until the lift amount of the work machine reaches a predetermined threshold, that is, until the boom angle increase amount reaches the threshold θ2. However, the configuration is not limited thereto. For example, in another embodiment, the control device 300 may perform the lift control with a constant lift control amount in the control amount setting stage ST2, and may determine the specific lift control amount h and the specific tilt control amount p to monotonically increase with respect to the boom angle after a certain period of time elapses.

In addition, the control device 300 according to the first embodiment determines a magnitude of the control amount in the tilt control command output to the control valve 261 as the tilt control amount for the work machine 120. However, in another embodiment, the configuration is not limited thereto. For example, the control device 300 according to another embodiment may determine a bucket angle increase threshold as a transition condition from the automatic tilt stage ST6 to the automatic tilt end stage ST7. Specifically, the control device 300 according to another embodiment may perform the automatic excavation control in accordance with the following procedure.

In the control amount setting stage ST2, the control amount determination unit 314 determines a bucket angle increase amount threshold to monotonically increase with respect to the lift force. In the automatic tilt stage ST6, the command output unit 316 outputs a tilt control command with a constant tilt control amount. In the automatic tilt stage ST6, the stage specifying unit 313 specifies that the stage of the automatic excavation control is the automatic tilt end stage ST7, when the bucket angle increase amount from the bucket angle at the time of transition from the tilt start determination stage ST5 to the automatic tilt stage ST6 reaches the bucket angle increase amount threshold value determined in the control amount setting stage ST2.

The work vehicle 100 according to the above-described embodiment performs automatic drive control on the tilt operation and the dump operation of the bucket 122, based on the bucket angle $\theta_B$. However, the configuration is not limited thereto. For example, the work vehicle 100 according to another embodiment may obtain a stroke amount of the bucket cylinder 125, and may perform automatic drive control on the tilt operation and the dump operation, based on the stroke amount of the bucket cylinder 125. The stroke amount of the bucket cylinder 125 may be obtained by the bucket stroke sensor 1251, or may be calculated based on the measurement value of the angle sensor provided at the bell crank 123 and the boom angle $\theta_L$. In addition, due to a mechanism of the work machine 120, when the boom 121 is raised, a bell crank angle is changed even when the bucket cylinder 125 is not driven. Therefore, the control device 300 of the work vehicle 100 measures, in advance, the stroke amount (reference stroke amount) of the bucket cylinder 125 in a state where the bucket 122 is in contact with the ground, and performs the automatic excavation control, based on the difference between the reference stroke amount and the stroke amount of the bucket cylinder 125. In this manner, when the boom 121 is lowered to the vicinity of the ground surface, the bottom surface of the bucket 122 can be substantially parallel to the ground surface. In this case, the bucket angle increase amount threshold is converted into the value of the stroke amount with respect to the reference stroke amount, and is compared therewith.

In addition, the control device 300 according to the above-described embodiment specifies the lift force of the work machine 120, based on the bottom pressure of the lift cylinder 124. However, the configuration is not limited thereto. For example, the control device 300 according to another embodiment may specify the lift force by using other amounts such as the pressure of the variable capacity pump 260 and the torque detected by the torque sensor.

In addition, the control device 300 according to the above-described embodiment specifies the lift amount of the work machine 120, based on the boom angle. However, the configuration is not limited thereto. For example, the control device 300 according to another embodiment may specify the lift amount of the work machine 120 by using other amounts such as the stroke amount of the lift cylinder 124 and the height of the bucket 122.

In addition, in the control device 300 according to the above-described embodiment, the stage transitions to the tilt standby stage ST4 by passing through the automatic tilt end stage ST7 after the automatic tilt stage ST6 ends. However, the configuration is not limited thereto. For example, in the control device 300 according to another embodiment, the stage may transition to the tilt standby stage ST4 after the automatic tilt stage ST6 ends without passing through the automatic tilt end stage ST7. In this case, the control device 300 increments the number of automatic tilt operations stored in the tilt count storage unit 335, when the stage transitions from the automatic tilt stage ST6 to the tilt standby stage ST4.

In addition, in the control device 300 according to the above-described embodiment, the stage transitions to the tilt standby stage ST4 after the automatic lift stage ST3 ends. However, the configuration is not limited thereto. For example, in the control device 300 according to another embodiment, the stage may transition to the automatic tilt stage ST6 after the automatic lift stage ST3 ends.

According to the above-described disclosure of the present invention, the work machine control device can perform the excavation control in accordance with a state of the excavation object.

What is claimed is:

1. A work machine control device that controls a work machine, the work machine control device comprising:

a lift force detection unit that detects a lift force of the work machine;

a control amount determination unit that determines a control amount for the work machine based on a change amount of the detected lift force; and a command output unit that outputs, to an actuator driving the work machine, a control command according to the determined control amount, the control amount determination unit determining the control amount such that the control amount monotonically increases with respect to the lift force until a lift amount of the work machine reaches a predetermined threshold.

2. The work machine control device according to claim 1, wherein after the lift amount of the work machine reaches the predetermined threshold, the control amount determination unit sets the control amount to be a control amount at the time the lift amount of the work machine reaches the predetermined threshold.

3. The work machine control device according to claim 1, wherein the control amount determination unit sets, to be the control amount for the work machine, a smaller amount of the control amount based on the lift force and a control amount based on an accelerator operation amount.

4. The work machine control device according to claim 1, wherein the control amount includes a lift control amount for lifting the work machine.

5. The work machine control device according to claim 1, wherein the control amount includes a tilt control amount for tilting the work machine.

6. A work vehicle including the work machine control device according to claim 1, the work vehicle further comprising:

a vehicle body;

a work machine supported by the vehicle body; and an actuator that drives the work machine.

7. A method of controlling a work machine, the method comprising:

detecting a lift force of the work machine;

determining a control amount for the work machine, based on a change amount of the detected lift force; and outputting, to an actuator driving the work machine, a control command according to the determined control amount.

* * * * *